US008430096B2

(12) United States Patent
Chambers

(10) Patent No.: US 8,430,096 B2
(45) **Date of Patent: *Apr. 30, 2013**

(54) SELF RESCUER INCLUDING SELF-CONTAINED BREATHING APPARATUS (SCBA) AND BREATHING AIR MONITOR (BAM)

(75) Inventor: Paul A. Chambers, Harvard, MA (US)

(73) Assignee: Avon Protection Systems, Inc., Cadillac, MI (US)

( * ) Notice: Subject to any disclaimer, the term of this patent is extended or adjusted under 35 U.S.C. 154(b) by 35 days.

This patent is subject to a terminal disclaimer.

(21) Appl. No.: 13/373,195

(22) Filed: Nov. 8, 2011

(65) Prior Publication Data

US 2012/0132200 A1 May 31, 2012

Related U.S. Application Data

(60) Division of application No. 12/148,595, filed on Apr. 21, 2008, which is a continuation-in-part of application No. 12/006,667, filed on Jan. 3, 2008, now Pat. No. 8,118, 022.

(60) Provisional application No. 60/925,314, filed on Apr. 19, 2007, provisional application No. 60/965,464, filed on Aug. 20, 2007.

(51) Int. Cl.
*A62B 9/04* (2006.01)

(52) U.S. Cl.
USPC ..... 128/202.27; 128/202.24; 128/205.28

(58) Field of Classification Search ..... 128/202.27, 128/204.18, 204.28, 205.22; 340/632
See application file for complete search history.

(56) References Cited

U.S. PATENT DOCUMENTS

| | | | | |
|---|---|---|---|---|
| 2,948,553 | A | | 8/1960 | Gill et al. |
| 3,077,880 | A | | 2/1963 | Morton, Jr. |
| 3,908,649 | A | * | 9/1975 | Eckstein ..... 128/201.13 |
| 4,168,706 | A | | 9/1979 | Fletcher et al. |
| 4,300,547 | A | | 11/1981 | Pasternack |
| 4,342,913 | A | | 8/1982 | Shepherd |
| 4,409,978 | A | | 10/1983 | Bartos |
| 4,569,223 | A | * | 2/1986 | Hubner ..... 73/23.2 |
| 4,794,923 | A | | 1/1989 | Bartos |
| 4,821,711 | A | | 4/1989 | Eckstein et al. |
| 4,959,637 | A | * | 9/1990 | Woods et al. ..... 340/573.1 |
| 5,036,841 | A | * | 8/1991 | Hamilton ..... 128/202.26 |

(Continued)

OTHER PUBLICATIONS

Kutz, D.H., Workman wearing all service gas mask and holding mine lamp, MSHA Accident Archive, Bureau of Mines OT Collection, 1925.*

(Continued)

*Primary Examiner* — Loan Thanh
*Assistant Examiner* — Peter S Vasat
(74) *Attorney, Agent, or Firm* — Pandiscio & Pandiscio

(57) ABSTRACT

A self-rescuer comprising a self-contained breathing apparatus (SCBA); and a smart light; wherein the smart light comprises a battery; a light bulb; circuitry connecting the battery to the light bulb; a detector for detecting the presence of a hazardous atmospheric condition; and alert apparatus connected to the detector for alerting a user when a hazardous atmospheric condition is detected by the detector, and further wherein the alert apparatus is connected to the circuitry and configured so as to flash the light bulb when a hazardous atmospheric condition is detected.

18 Claims, 20 Drawing Sheets

U.S. PATENT DOCUMENTS

| | | | | |
|---|---|---|---|---|
| 5,297,544 | A * | 3/1994 | May et al. | 128/202.22 |
| 5,562,092 | A * | 10/1996 | George | 128/201.25 |
| 5,619,988 | A | 4/1997 | Mattila et al. | |
| 5,746,199 | A | 5/1998 | Bayron et al. | |
| 6,761,162 | B1 | 7/2004 | Swann | |
| 8,118,022 | B2 * | 2/2012 | Chambers | 128/202.27 |
| 2002/0135488 | A1 | 9/2002 | Hibbs et al. | |
| 2002/0155622 | A1 | 10/2002 | Slater et al. | |
| 2003/0188744 | A1 | 10/2003 | Deas et al. | |
| 2004/0220753 | A1 * | 11/2004 | Tabe | 702/32 |
| 2006/0076896 | A1 | 4/2006 | Osborn et al. | |
| 2006/0175565 | A1 | 8/2006 | Nungesser et al. | |
| 2006/0201509 | A1 | 9/2006 | Forsyth et al. | |
| 2007/0060874 | A1 | 3/2007 | Nesbitt et al. | |

OTHER PUBLICATIONS

Ocenco, Inc. EBA 6.5 product brochure, Dec. 3, 2003, http://web.archive.org/web/20031203154508/http://ocenco.com/EBA6.5.pdf.

Kyriazi et al., "Self-Contained Self-Rescuer Field Evaluation: Seventh Phase Results", Mar. 2002.

* cited by examiner

ONLY SIDE SWITCHED TO IS ACTIVE

TWO ELEMENTS CONNECTED

SELF RESCUER INCLUDING SELF-CONTAINED BREATHING APPARATUS (SCBA) AND BREATHING AIR MONITOR (BAM)

REFERENCE TO PENDING PRIOR PATENT APPLICATIONS

This patent application is a division of pending prior U.S. patent application Ser. No. 12/148,595, filed Apr. 21, 2008 by Paul A. Chambers for SELF RESCUER INCLUDING SELF-CONTAINED BREATHING APPARATUS (SCBA) AND BREATHING AIR MONITOR (BAM), which in turn:

(i) is a continuation-in-part of pending prior U.S. patent application Ser. No. 12/006,667, filed Jan. 3, 2008 now U.S. Pat. No. 8,118,022 by Paul A. Chambers for SELF-CONTAINED BREATHING APPARATUS (SCBA) WITH SAFETY QUICK DISCONNECT FOR PERMITTING SAFE AND READY ACCESS TO A REPLACEMENT BREATHING COMPONENT;

(ii) claims benefit of prior U.S. Provisional Patent Application Ser. No. 60/925,314, filed Apr. 19, 2007 by Paul A. Chambers for SELF CONTAINED SELF RESCUER—PLUS; and (iii) claims benefit of prior U.S. Provisional Patent Application Ser. No. 60/965,464, filed Aug. 20, 2007 by Paul A. Chambers for UNIVERSAL MINER SELF RESCUER (UMSR).

The above-identified patent applications are hereby incorporated herein by reference.

FIELD OF THE INVENTION

This invention relates to self rescuers in general, and more particularly to a self rescuer comprising a self-contained breathing apparatus (SCBA) and a breathing air monitor (BAM).

BACKGROUND OF THE INVENTION

The nature of underground mining operations makes them highly dangerous.

For example, in the case of a mine collapse, the supply of breathable air can be severely compromised, placing the miners in great danger.

Furthermore, mines are often highly susceptible to the infusion of noxious gases (e.g., methane, carbon monoxide, etc.). This situation can occur in many scenarios, even where there is no catastrophic mine collapse. Gas pockets can be exposed at any time and without notice, and can be life-threatening even where the mine is structurally intact. In any of these situations, once the gas enters the space occupied by the miners, their lives are in serious danger.

In all of these situations, the miners must (i) quickly recognize the danger, and then (ii) obtain a supply of breathable air. Various detectors (e.g., CO detectors) can be employed by miners in order to detect a situation in which breathing conditions may be compromised. In such a compromised breathing condition, the supply of breathable air may be provided by various means, e.g., a filtered system, a conventional "open-loop" self-contained breathing apparatus (SCBA), a conventional "closed-loop" self-contained breathing apparatus (SCBA), a solid state oxygen generator, etc. The equipment for providing the supply of breathable air is commonly referred to as a Self Rescuer and is generally carried by the miners on their belts. Once the miners have "switched over" to this supply of breathable air, they must then escape the danger zone. In the case of a "benign" gas pocket, escape may be as simple as walking or riding a mine car out of the affected area. In the case of a mine collapse, gas explosion, or other serious event, escape may involve crawling, tunneling, walking or just waiting for rescue. In any of these latter situations, there is a significant danger that the supply of breathable air may be depleted before the miner has reached a safe location.

At the same time, in many of these situations, it is not possible for the miners to use conventional negative pressure filtered respirators, powered air purifying respirator (PAPR), etc. due to the nature of the threat, e.g., the possible air contaminants (e.g., some gases), the physical state of the ambient air (e.g., super-heated air), etc. In these situations, a self-contained breathing apparatus (SCBA) is required.

Conventional "open-loop" SCBA units generally consist of a tank of compressed gas (usually ambient, but filtered, air) with the flow controlled by a regulator or demand valve. One of the major inefficiencies of these units is that the exhausted and/or exhaled air (still containing significant usable oxygen) is vented to the environment and thus lost to the user. Much greater efficiencies (translating into smaller, lighter units and longer supply times) can be attained by using "closed loop" SCBA units which recycle the exhaust air and recover the oxygen, and/or remove the undesirable products of respiration (mainly carbon dioxide). A device utilizing this approach is commonly referred as a "Rebreather". See FIG. 1.

Any respirator device, whether filtered, open-loop SCBA, closed-loop SCBA, etc. has a limited capacity to supply breathable air. If the miners exhaust the capacity of the respirator device while still in a dangerous environment, the miners must be able to access a replacement breathing component and make the "change-over" to the replacement breathing component without "breaking the seal" or otherwise exposing themselves to breathing in the potentially noxious gases.

As a result, a primary object of the present invention is to provide a self-contained breathing apparatus (SCBA) which is able to safely and quickly connect to a replacement breathing component without "breaking the seal" so that the replacement breathing component can supply additional breathing capacity to the user. Preferably, the replacement breathing component can take any number of forms, e.g., the working portion of another "closed-loop" SCBA, an air bottle, a carbon monoxide filter respirator, etc.

In addition to the foregoing, where the miner has an SCBA system which provides a choice of different breathing options (e.g., connection to breathable air, use of a CO absorber, etc.), it would be beneficial for the miner to be given an indication of the nature of the atmospheric threat, in order that the miner might apply their SCBA system in the most efficient manner possible. By way of example but not limitation, where the SCBA has a limited supply of breathable air and a CO absorber, and where the atmospheric threat comprises CO, the miner might be best advised to utilize the CO absorber and conserve the limited supply of breathable air. On the other hand, if the atmospheric threat comprises methane, the miner will be best advised to use the limited supply of breathable air.

To this end, it is another primary object of the present invention to provide a breathing air monitor (BAM) for monitoring atmospheric conditions and alerting the miner to the presence of atmospheric threats.

SUMMARY OF THE INVENTION

The present invention provides a self-contained breathing apparatus (SCBA) which is able to safely and quickly connect to a replacement breathing component without "breaking the seal" so that the replacement breathing component can supply additional breathing capacity to the user.

In one form of the present invention, there is provided a self-contained breathing apparatus (SCBA) comprising:

a mouthpiece;

a breathing component for providing breathable air, the breathing component comprising a component interface; and a safety quick disconnect comprising:

a valve body defining:

an internal chamber;

an opening communicating with the internal chamber and connectable with the mouthpiece;

first and second ports communicating with the internal chamber;

first and second mounts formed on the body adjacent to the first and second ports, respectively, for receiving the component interface of the breathing component, the first and second mounts being configured so as to place the breathing component into communication with the internal chamber when the component interface is in engagement with one or the other of the first and second mounts;

a valve spool selectively rotatably disposed within the internal chamber, wherein the valve spool comprises an L-shaped channel formed such that when the valve spool is appropriately rotated, the L-shaped channel (i) places the opening in communication with the first port, or (ii) places the opening in communication with the second port; and a lock mechanism for (i) preventing the valve spool from being rotated unless the component interface of the breathing component is positioned in one of the first and second mounts and a component interface of a replacement breathing component is positioned in the other of the first and second mounts, and (ii) preventing the removal of a component interface from a mount adjacent to a port which is in communication with the opening.

In another form of the present invention, there is provided a self-contained breathing apparatus (SCBA) comprising:

a mouthpiece;

a counterlung; and a breathing component interposed between the mouthpiece and the counterlung, the breathing component being adapted to provide breathable air; wherein the counterlung is sized so as to have a volume which is approximately equal to the tidal volume of a pair of adult lungs.

In another form of the present invention, there is provided a smart light comprising:

a battery;

a light bulb;

circuitry connecting the battery to the light bulb;

a detector for detecting the presence of a hazardous atmospheric condition; and alert apparatus connected to the detector for alerting a user when a hazardous atmospheric condition is detected by the detector.

In another form of the present invention, there is provided a self-rescuer comprising:

a self-contained breathing apparatus (SCBA); and a smart light;

wherein the smart light comprises:

a battery;

a light bulb;

circuitry connecting the battery to the light bulb;

a detector for detecting the presence of a hazardous atmospheric condition; and alert apparatus connected to the detector for alerting a user when a hazardous atmospheric condition is detected by the detector, and further wherein the alert apparatus is connected to the circuitry and configured so as to flash the light bulb when a hazardous atmospheric condition is detected.

BRIEF DESCRIPTION OF THE DRAWINGS

These and other objects and features of the present invention will be more fully disclosed or rendered obvious by the following detailed description of the preferred embodiments of the invention, which are to be considered together with the accompanying drawings wherein like numbers refer to like elements and further wherein.

DETAILED DESCRIPTION OF THE INVENTION

Figure 1:
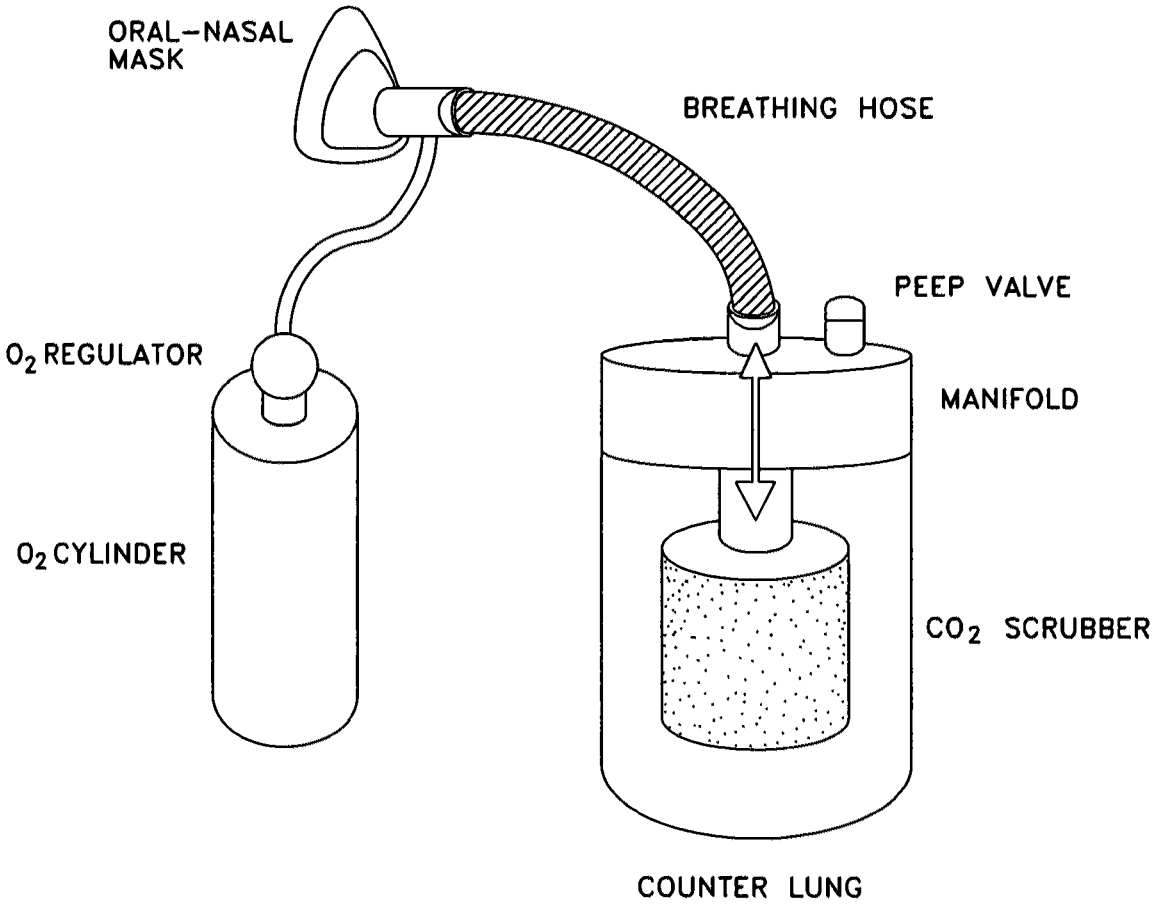
FIG. 1 (PRIOR ART)
FIG. 1 is a schematic view showing a prior art SCBA.
Figure 2:
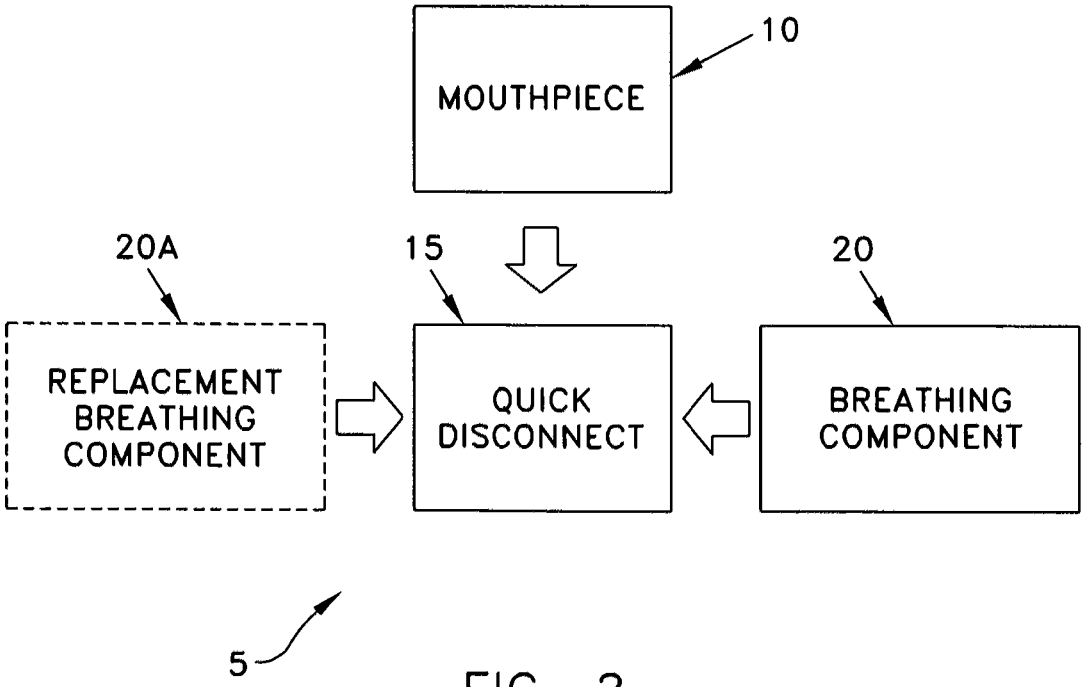
FIG. 2 is a schematic diagram showing a high-level overview of a novel SCBA formed in accordance with the present invention.
Figure 3:
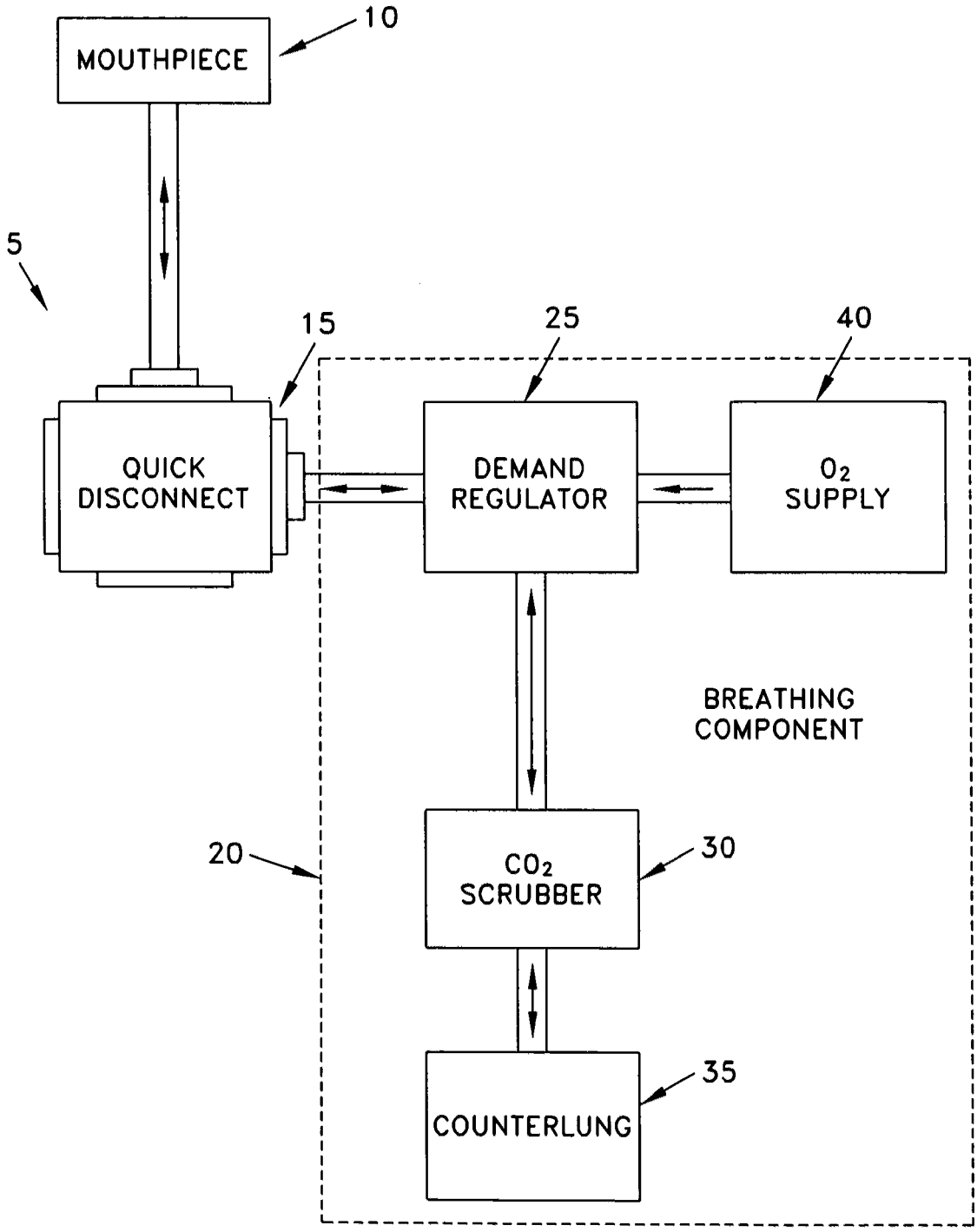
FIG. 3 is a schematic diagram showing a more detailed illustration of a novel SCBA formed in accordance with the present invention.

Self-Contained Breathing Apparatus (SCBA) with Safety Quick Disconnect for Permitting Safe and Ready Access to a Replacement Breathing Component Looking next at FIGS. 2 and 3, there is shown a novel self-contained breathing apparatus (SCBA) 5 formed in accordance with the present invention. SCBA 5 generally comprises a mouthpiece 10 which is releasably connected to a multi-port safety quick disconnect 15. Also connected to quick disconnect 15 is a breathing component 20. A replacement breathing component 20A may also be connected to quick disconnect 15 when breathing component 20 is to be replaced.

Figure 4:
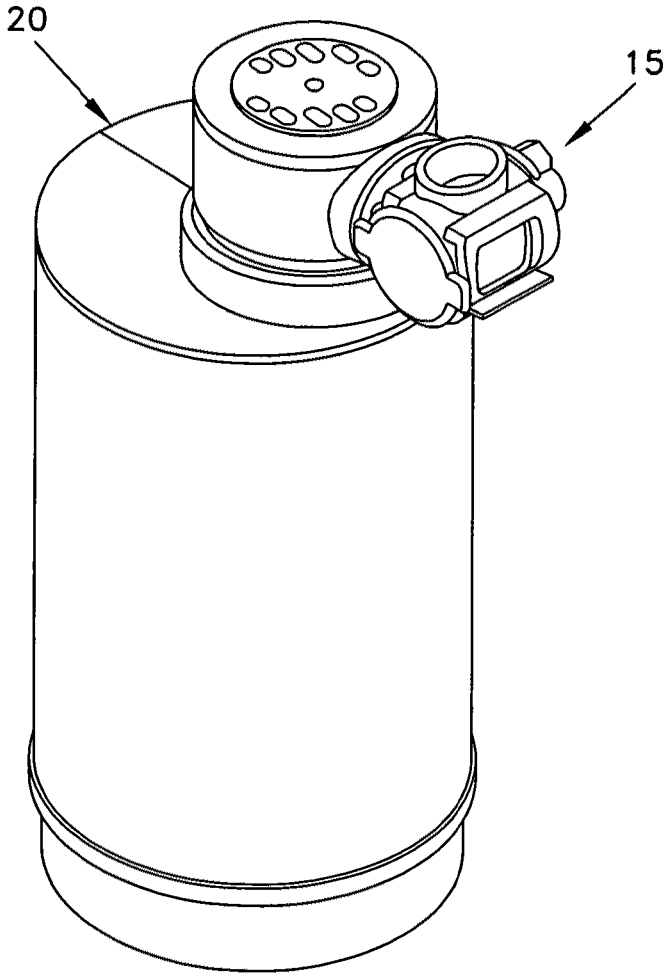
FIG. 4 is a schematic view showing a novel breathing component formed in accordance with the present invention.

Looking now at FIGS. 2-4, breathing component 20 preferably comprises a demand regulator 25, a carbon dioxide scrubber 30 and a counterlung 35. Breathing component 20 also comprises an oxygen supply 40.

During use, the user places mouthpiece 10 in their mouth and inhales and exhales through their mouth (a noseclip may also be supplied to restrict breathing through the nose and permit breathing through only the mouth). As air is exhaled, it passes through demand regulator 25, through carbon dioxide scrubber 30 and fills counterlung 35. As this occurs, carbon dioxide scrubber 30 purges carbon dioxide from the exhaled air. Conversely, as air is inhaled, air is drawn from counterlung 35, through carbon dioxide scrubber 30, through demand regulator 25 and back into the lungs of the user. Again, as the air from counterlung 35 passes through carbon dioxide scrubber 30, the scrubber purges carbon dioxide from the air.

Demand regulator 25 monitors the air pressure in the system and, when the air pressure falls below a certain threshold, releases supplemental oxygen from oxygen supply 40. More particularly, as the user breathes, the body metabolizes oxygen and releases carbon dioxide. This carbon dioxide is then removed from the system by carbon dioxide scrubber 30. Therefore, in a "closed-loop" system, as the user breathes, oxygen is consumed by the user, carbon dioxide is consumed by the scrubber, and the quantity of air is reduced. To that end, demand regulator 25 monitors the air pressure in the system and, as the quantity of air is reduced during breathing and scrubbing (which also reflects a reduction in the quantity of oxygen available for breathing), demand regulator 25 releases supplemental oxygen to the system to compensate for the consumed gases.

As a result of this construction, breathing component 20 is designed to provide extended breathing capacity, due to the use of (i) carbon dioxide scrubber 30, which allows the re-breathing of exhaled air, and (ii) demand regulator 25 and oxygen supply 40, which supply supplemental oxygen to the system as oxygen is consumed through breathing.

Significantly, counterlung 35 is carefully configured so as to have a size approximately equal to tidal volume of a pair of human lungs. This is approximately three times smaller than traditional counterlungs. By configuring counterlung 35 with this unique size, breathing component 20 ensures that demand regulator 25 will release fresh oxygen to the system before the oxygen content of the air being re-breathed falls to a level which is too low to safely sustain the user. More particularly, with each breath of the user, approximately 20% of the oxygen inhaled is consumed by the body and is replaced with exhaled carbon dioxide. This exhaled carbon dioxide is in turn purged by carbon dioxide scrubber 30. Thus, in the absence of a supplemental oxygen source, as the user breathes, the total quantity of air will continuously decrease as the carbon dioxide is pulled from the air. If counterlung 35 is made too large, it will take too long for the quantity of air in the system to be depleted to the point where demand regulator 25 will trigger the release of supplemental oxygen from oxygen supply 40. On the other hand, if counterlung 35 is formed too small, a user will not be able to inhale and exhale a full breath, which is important in emergency breathing situations where the user may need to be moving about rapidly. Sizing counterlung 35 so as to be the approximately the size of the tidal volume of a pair of lungs is a new and significant advance in the art.

Figure 6:
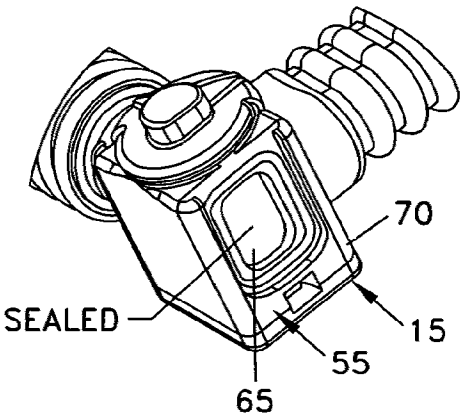
FIGS. 5-11 are schematic views showing a novel safety quick disconnect of the present invention.
Figure 8:
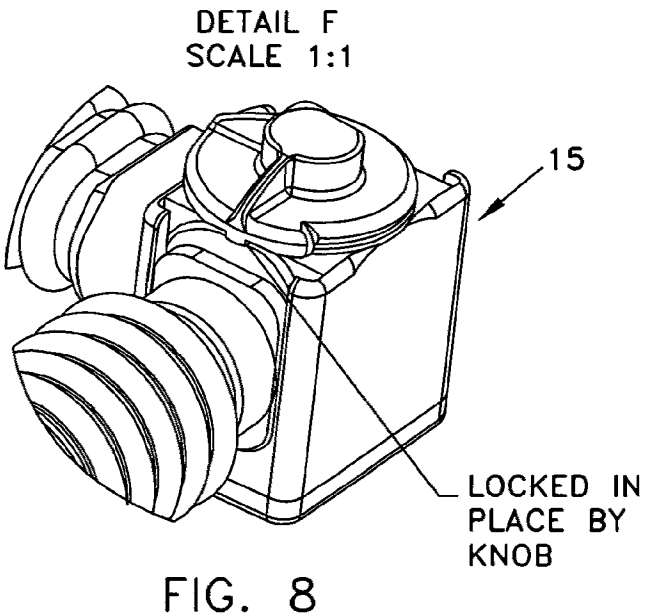
Figure 5:
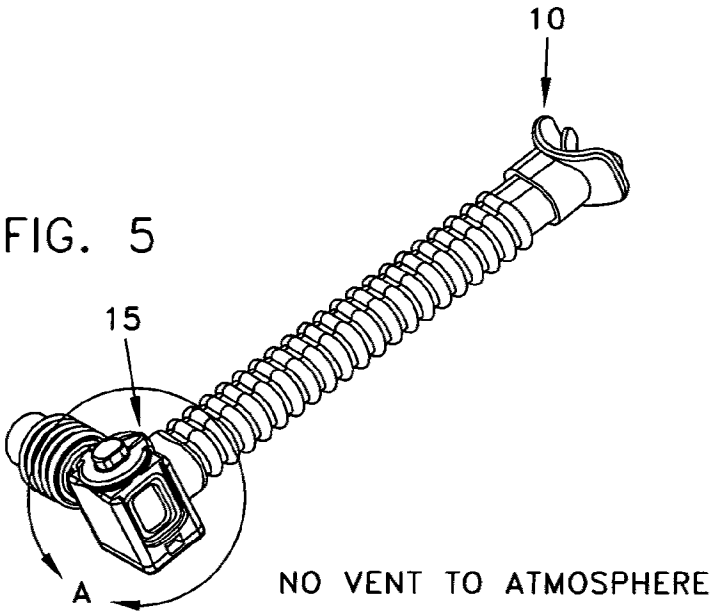
Figure 7:
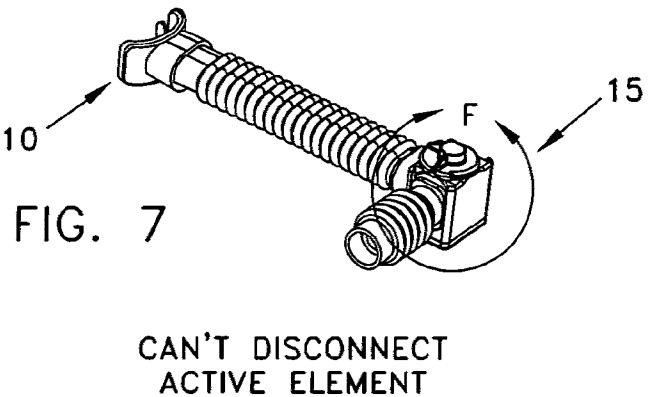
Figure 9:
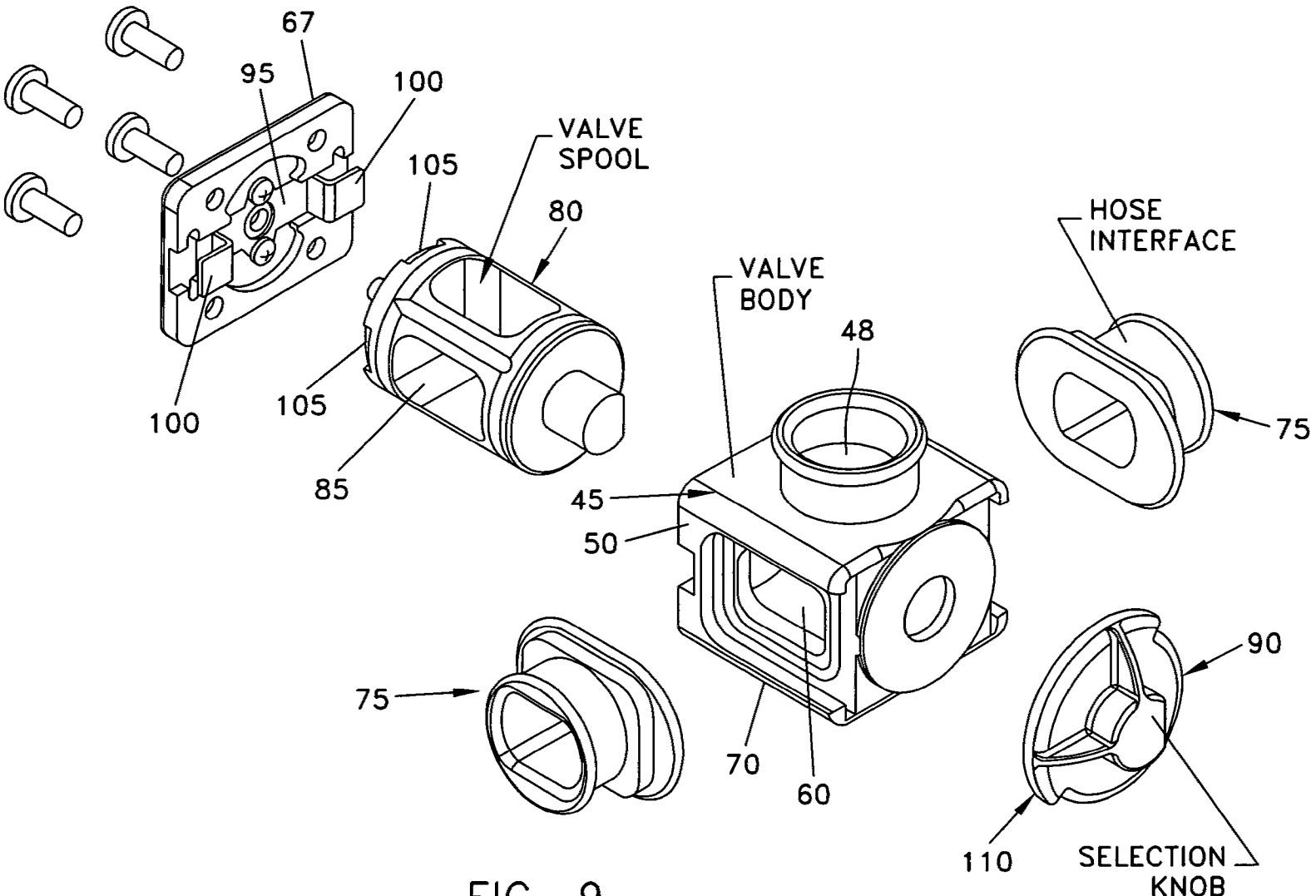
Figure 10:
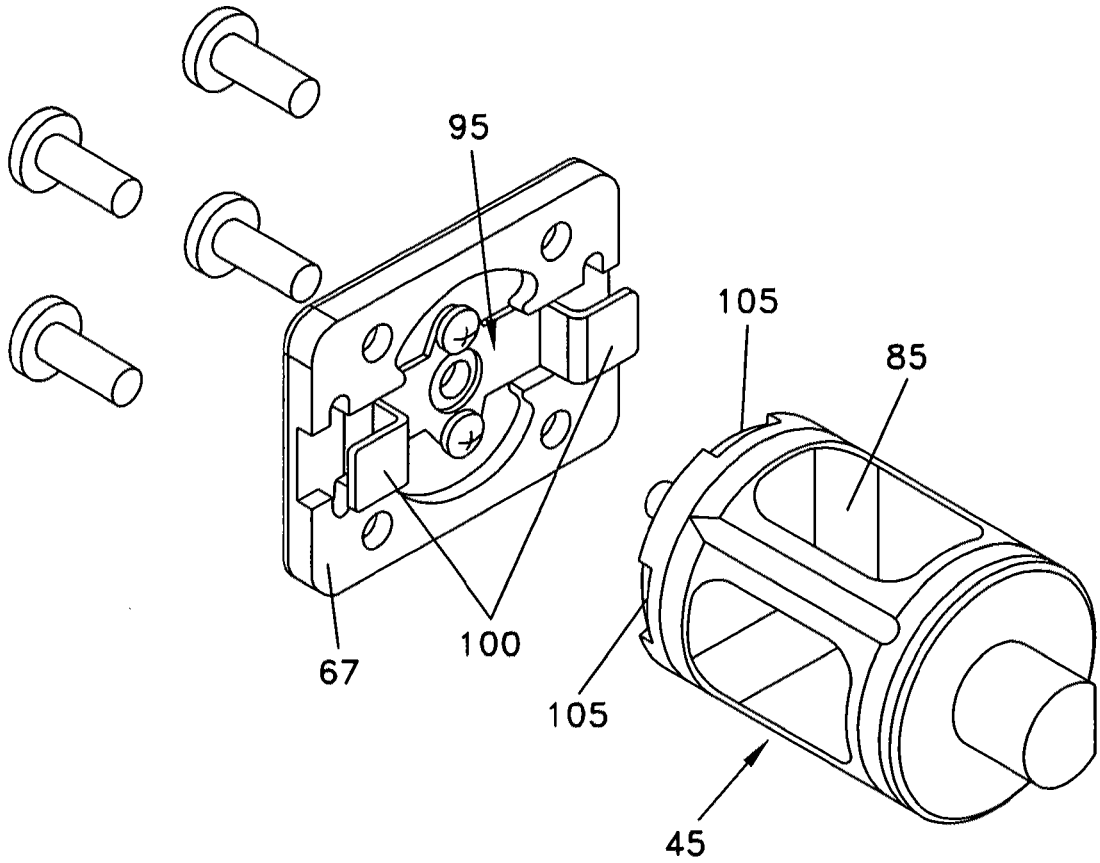
Figure 11:
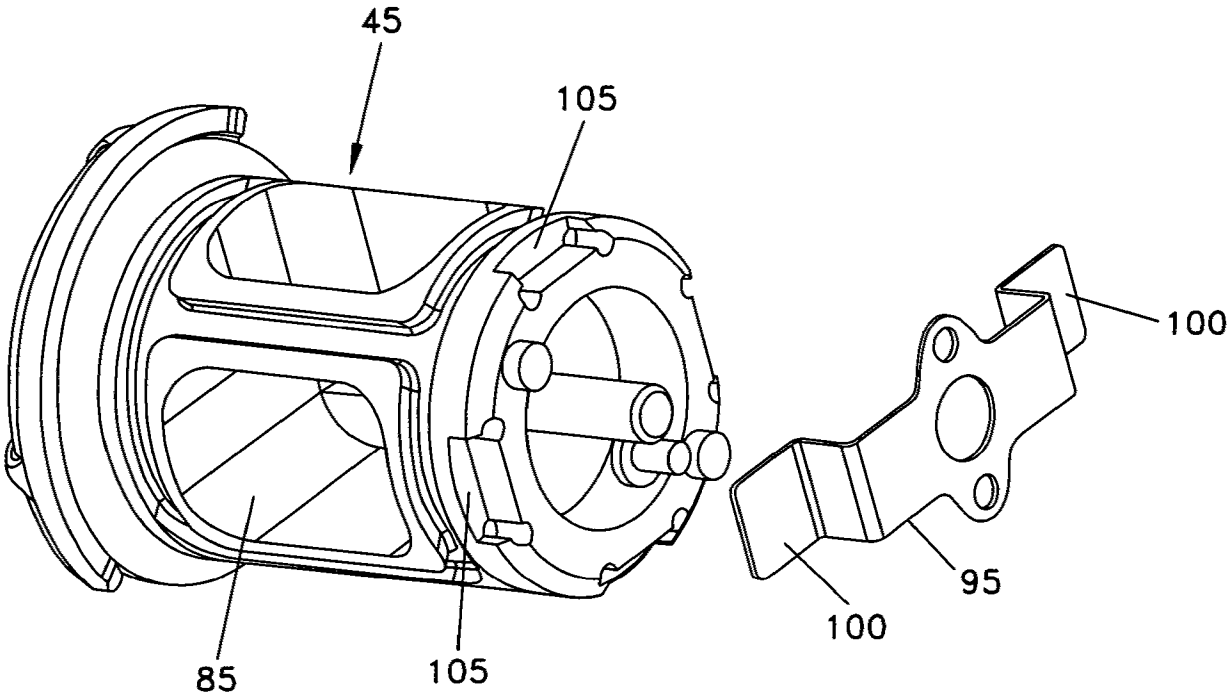

In another significant advance over the prior art, SCBA 5 utilizes a multi-port safety quick disconnect 15 to permit replacement breathing component 20A to be safely and quickly connected to mouthpiece 10 without "breaking the seal", so that additional breathing capacity can be safely supplied to the user when necessary. More particularly, any breathing component (e.g., a "closed-loop" SCBA system, a carbon dioxide absorber, an oxygen tank, etc.) has a finite functional lifetime: at the end of that functional lifetime, the breathing component must ultimately be replaced with a fresh unit in order to sustain a user. The present invention provides novel multi-port safety quick disconnect 15 to permit replacement breathing component 20A to be safely and quickly connected to mouthpiece 10 without "breaking the seal", so that additional breathing capacity can be safely supplied to the user when necessary Safety disconnect 15 is shown in greater detail in FIGS. 5-11. Safety disconnect 15 generally comprises a hollow rectangular valve body 45 having a top opening 48 for connecting to mouthpiece 10, two faces 50, 55 (FIGS. 6 and 9) with ports 60, 65 formed therein, respectively, and a back plate 67 for closing off valve body 45. The faces 50, 55 are each configured with a U-shaped rail 70 for slidably receiving, and forming an airtight seal with, a component interface 75 which connects with a breathing component. A cylindrical valve spool 80, with an L-shaped channel 85 formed therein, is rotatably disposed within valve body 45. A selection knob 90 is provided to permit the user to adjust the rotational position of valve spool 80 within valve body 45. As a result of this construction, L-shaped channel 85 can be used to connect port 60 with opening 48 or, alternatively, port 65 with opening 48.

Significantly, means are provided for restricting the position of valve spool 80 within valve body 45, and for restricting the inadvertent removal of a component interface 75 from valve body 45, whereby to present a user from accidentally breathing ambient air.

More particularly, back plate 67 includes a locking clip 95 having a pair of projecting spring fingers 100. Valve spool 80 includes four recesses 105 formed therein for selectively receiving spring fingers 100 of locking clip 95. As a result of this construction, valve spool 80 may not be rotated within valve body 45 unless, and until, two component interfaces 75 are pressed sufficiently rearwardly within U-shaped rail 70 as to push the two corresponding projecting spring fingers 100 out of their corresponding spool recesses 105.

Furthermore, selection knob 90 is provided with a peripheral extension 110 along a portion of its perimeter which prevents accidental removal of the component interface 75 selected by and in use on that corresponding side of the valve body so as to prevent the user accidentally disconnecting the active breathing air supply and exposing the corresponding port 60, 65 to atmosphere.

In addition to the foregoing, valve spool 80 is formed so that when it is in a locked position (i.e., so that a spring finger 100 is received in a spool recess 105), L-shaped channel 85 is connecting either port 60 with opening 48 or port 65 with opening 48.

Figure 12:
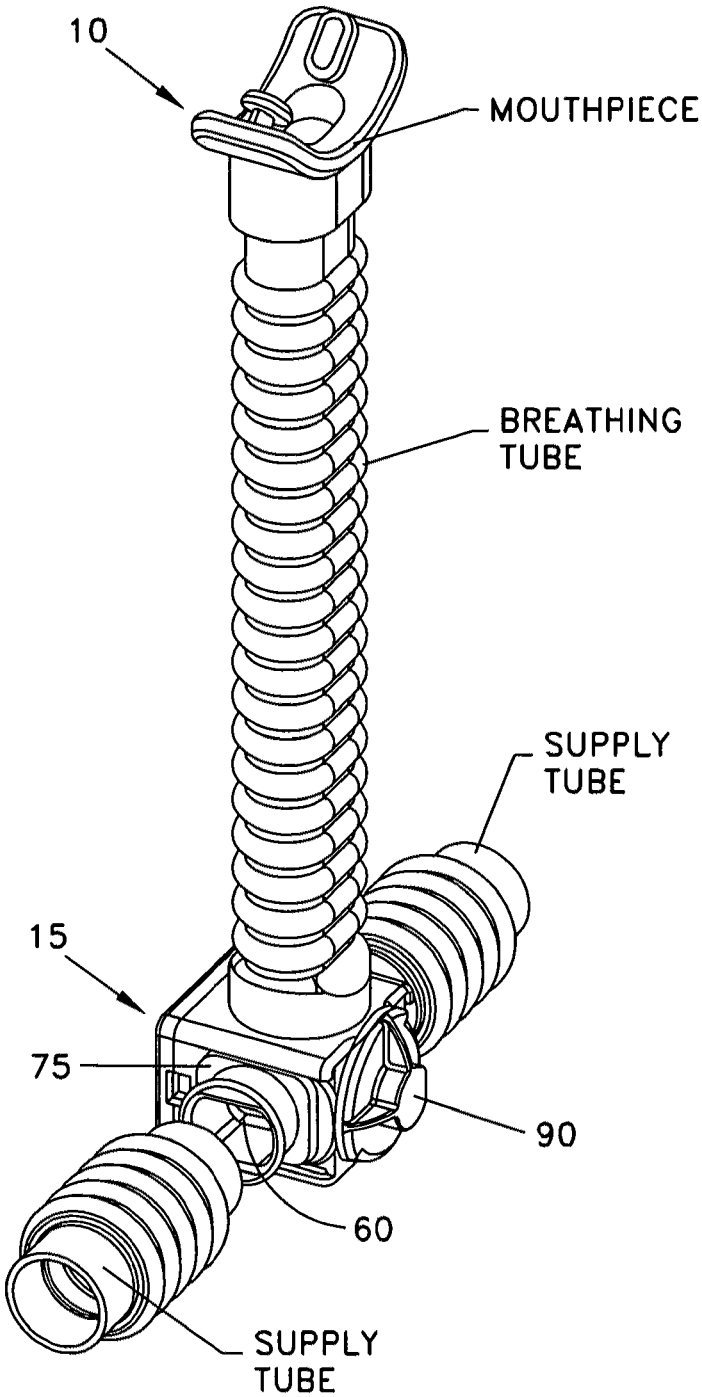
FIGS. 12-14 are schematic views illustrating how a breathing component and a replacement breathing component may be simultaneously connected to the safety quick disconnect, with only one breathing component being operable at a given time.
Figure 14:
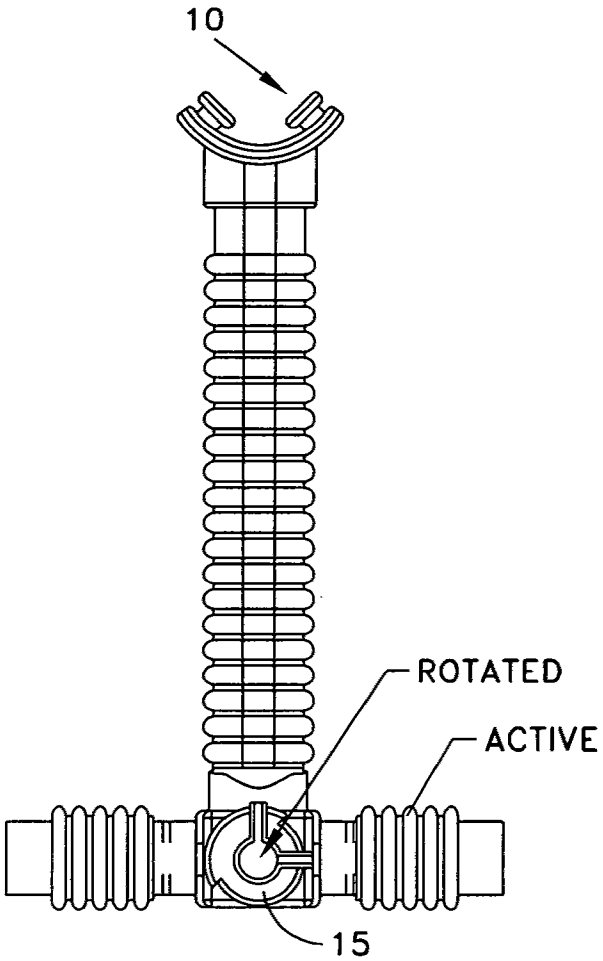
Figure 13:
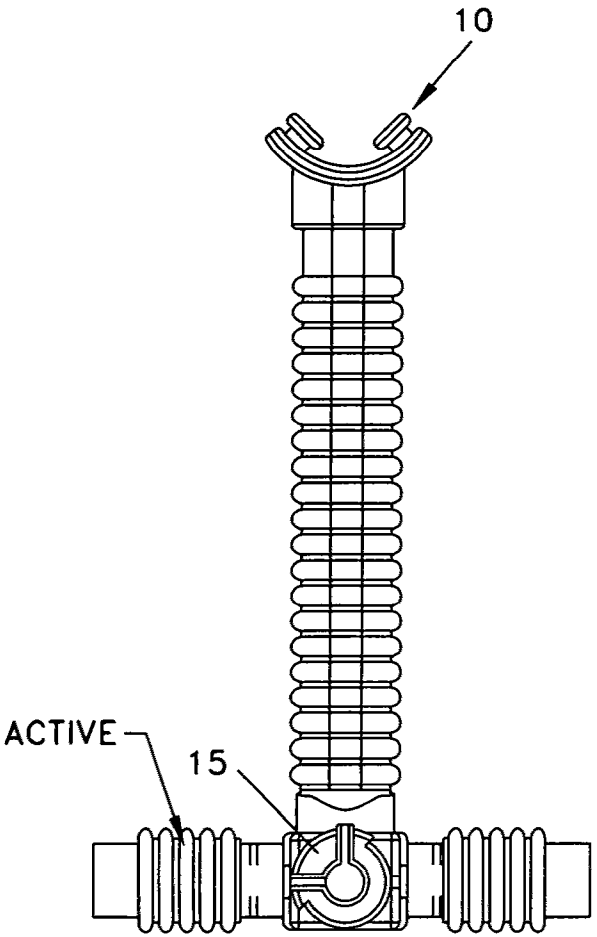
Figure 17:
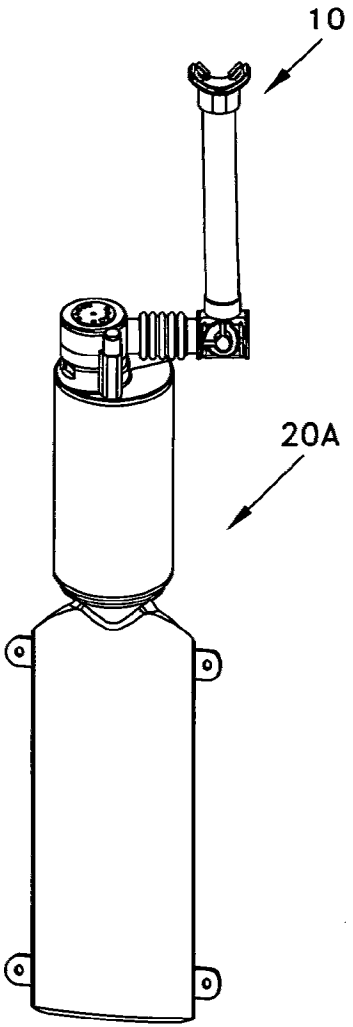
FIGS. 15-17 are schematic views showing how a depleted breathing component may be "switched out" (i.e., changed over) to a replacement breathing component.
Figure 16:
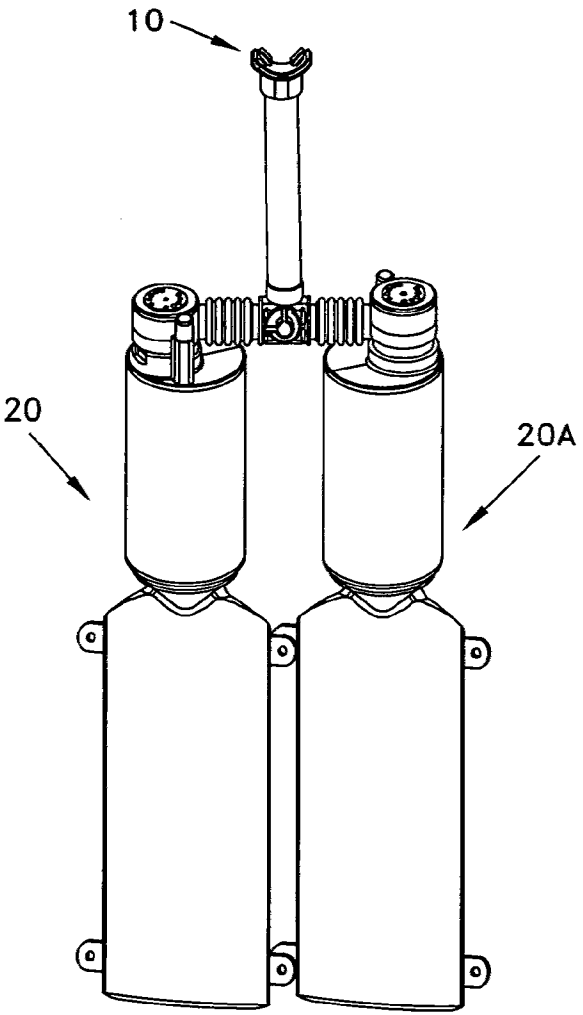
Figure 15:
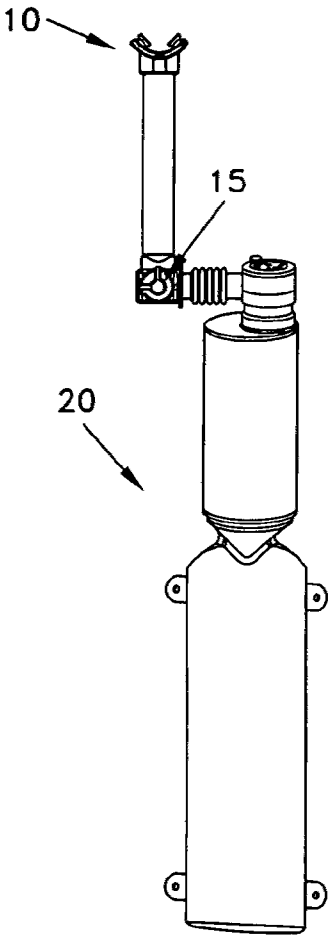
Figures 18, 19, 20, 21:
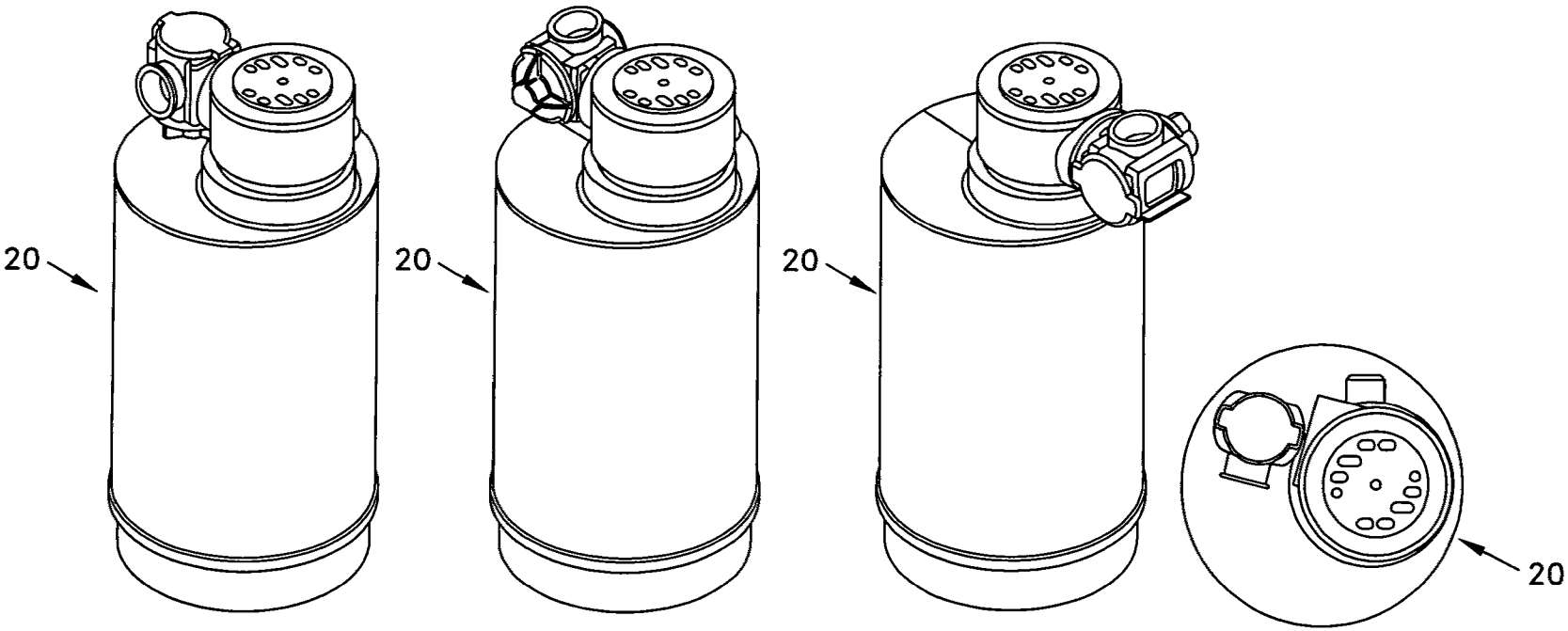
FIGS. 18-23 are schematic views illustrating various configurations for a novel breathing component formed in accordance with the present invention.

As a result of this construction, a component interface 75 may only be withdrawn when another component interface 75 has been connected to quick disconnect 15 and valve knob 90 has been rotated to select the side being retained as a breathing source. Furthermore, as shown in FIGS. 12-14, only one port 60, 65 may be open at any given time to mouthpiece 10. Thus, the mouthpiece can never be opened to ambient air. As a result, multi-port safety quick disconnect 15 permits a replacement breathing component to be safely and quickly connected to mouthpiece 10 without "breaking the seal", so that additional breathing capacity can be safely supplied to the user. In other words, a user cannot disconnect from a current breathing component unless, and until, a replacement breathing component has been properly connected to multi-port quick disconnect 15. Thus, the construction quick disconnect 15 prohibits a user from (i) accidentally disengaging a current breathing component until a replacement breathing component has been connected, and (ii) inadvertently connecting the mouthpiece to ambient air.

In other words, the foregoing construction permits a first breathing component is to be safely and readily replaced with a replacement breathing component when necessary. More particularly, and looking now at FIGS. 15-18, safety quick disconnect 15 permits a first breathing component 20 to be replaced with a replacement breathing component 20A, and the first breathing component 20 to be thereafter discarded.

Figure 22:
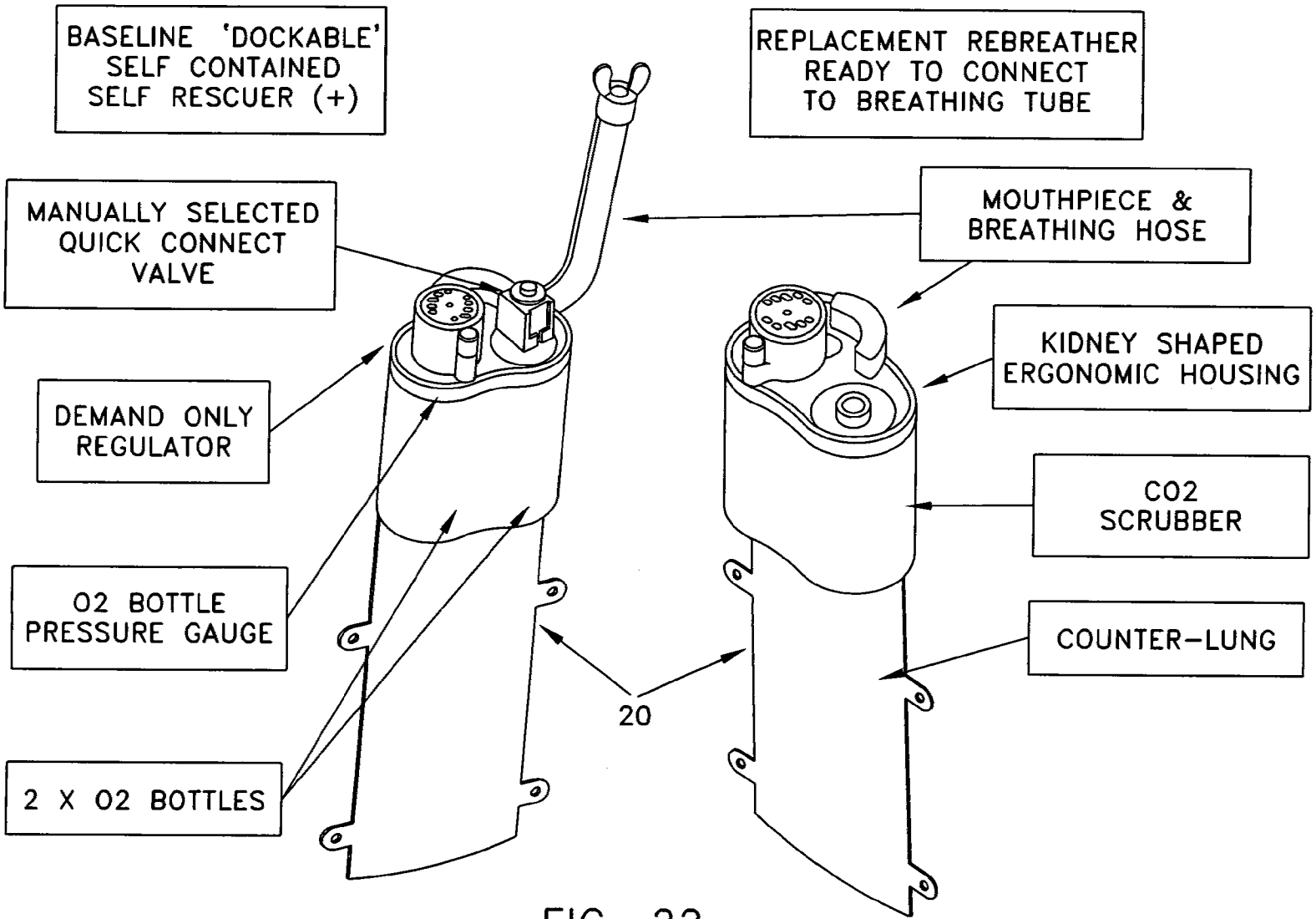

Looking next at FIGS. 18-21, it will be seen that quick disconnect 15 can be rotatably positioned in a variety of a configurations vis-à-vis breathing component 20 so as to provide a desired profile, e.g., so as to facilitate wearing on a belt, attachment to alternative breathing component, etc. Furthermore, breathing component 20 can have an ergonomic exterior shape so as to facilitate wearing it on a belt, e.g., the body of breathing component 20 can have a kidney-shaped cross-section and counterlung 35 can have a flat shape (when empty), etc. See, for example, FIG. 22.

Figure 23:
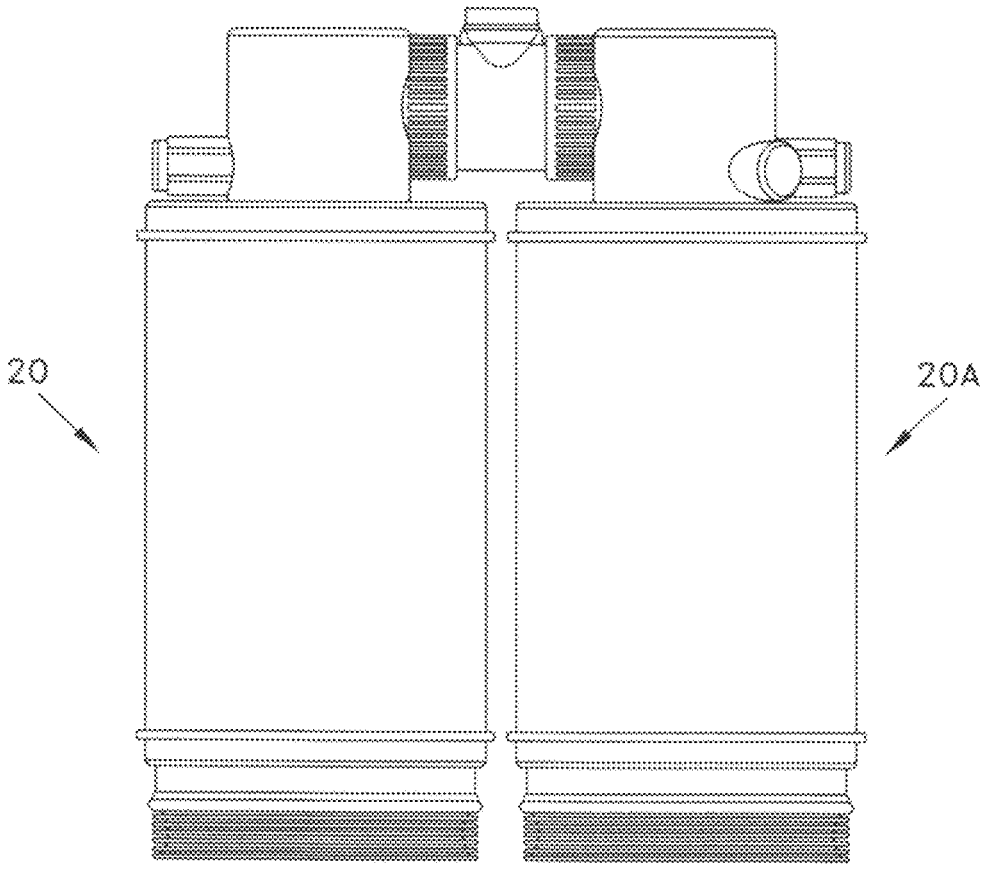
Figure 25:
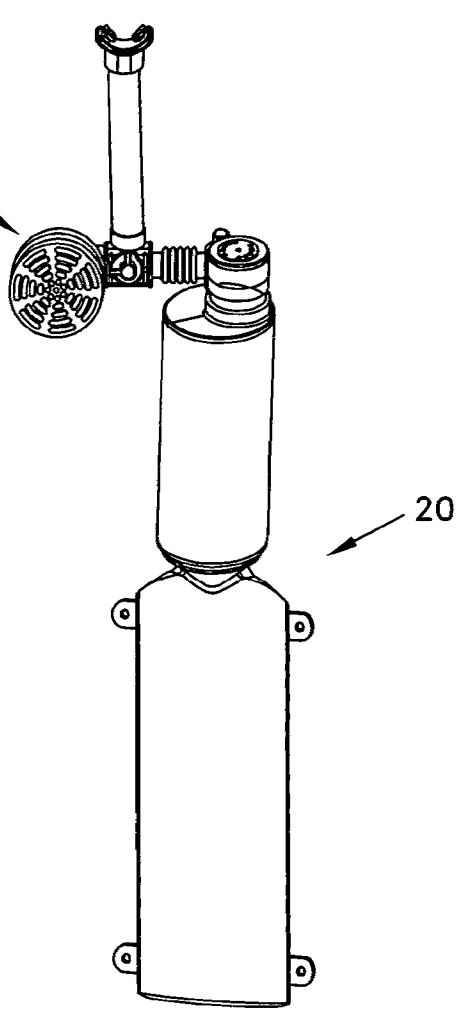
FIGS. 24-27 are schematic views illustrating various types of breathing components which can be connected to the safety quick disconnect.
Figure 26:
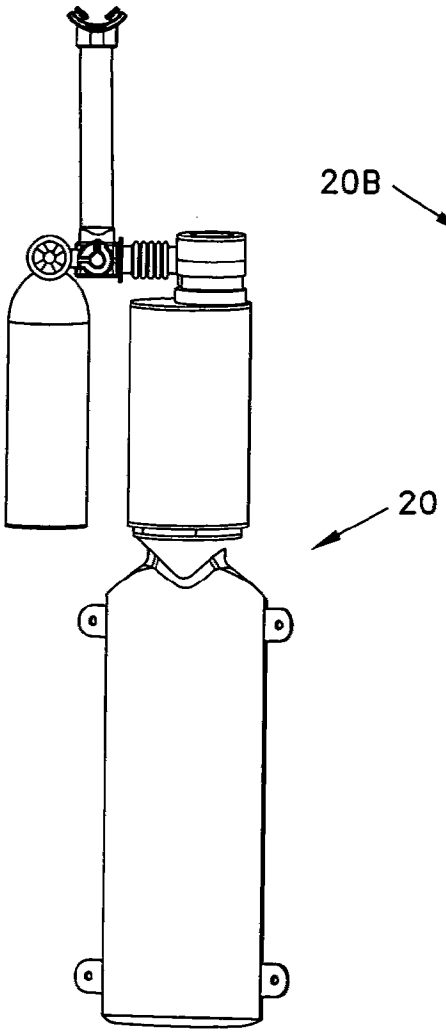
Figure 24:
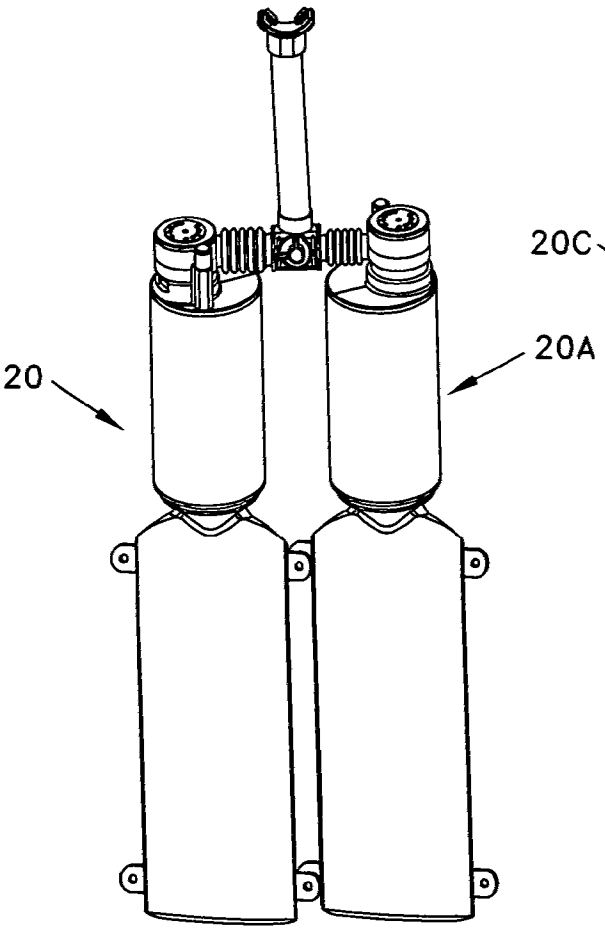
Figure 27:
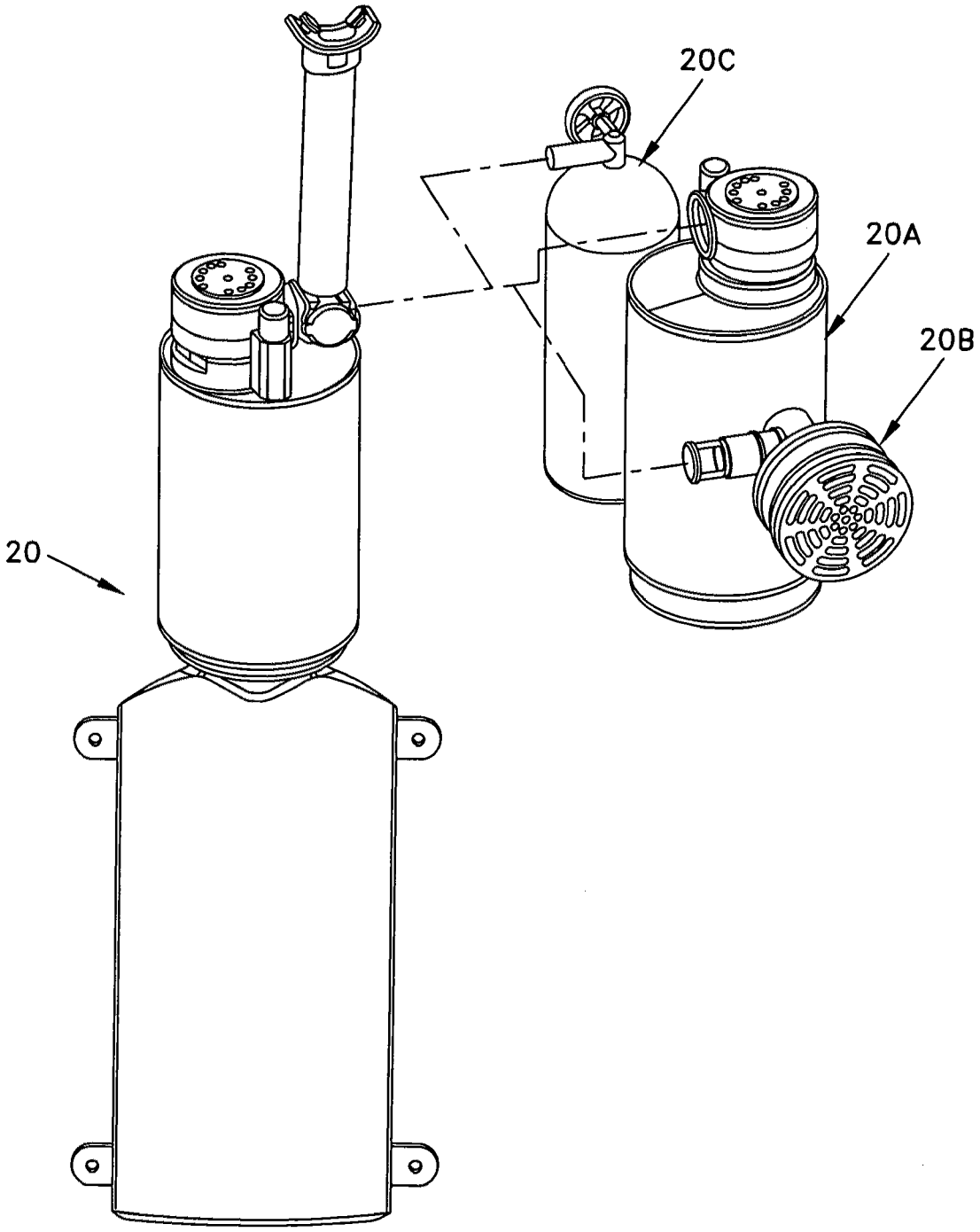

If desired, and as shown in FIGS. 23 and 24, quick disconnect 15 can be used to switch off between two identical breathing components 20, 20A. Alternatively, quick disconnect 15 can be connected to various other types of breathing components of the sort well known in the art, e.g., a carbon monoxide absorber 20B (FIG. 25), an oxygen bottle 20C (FIG. 26), etc. See also FIG. 27.

Figure 28:
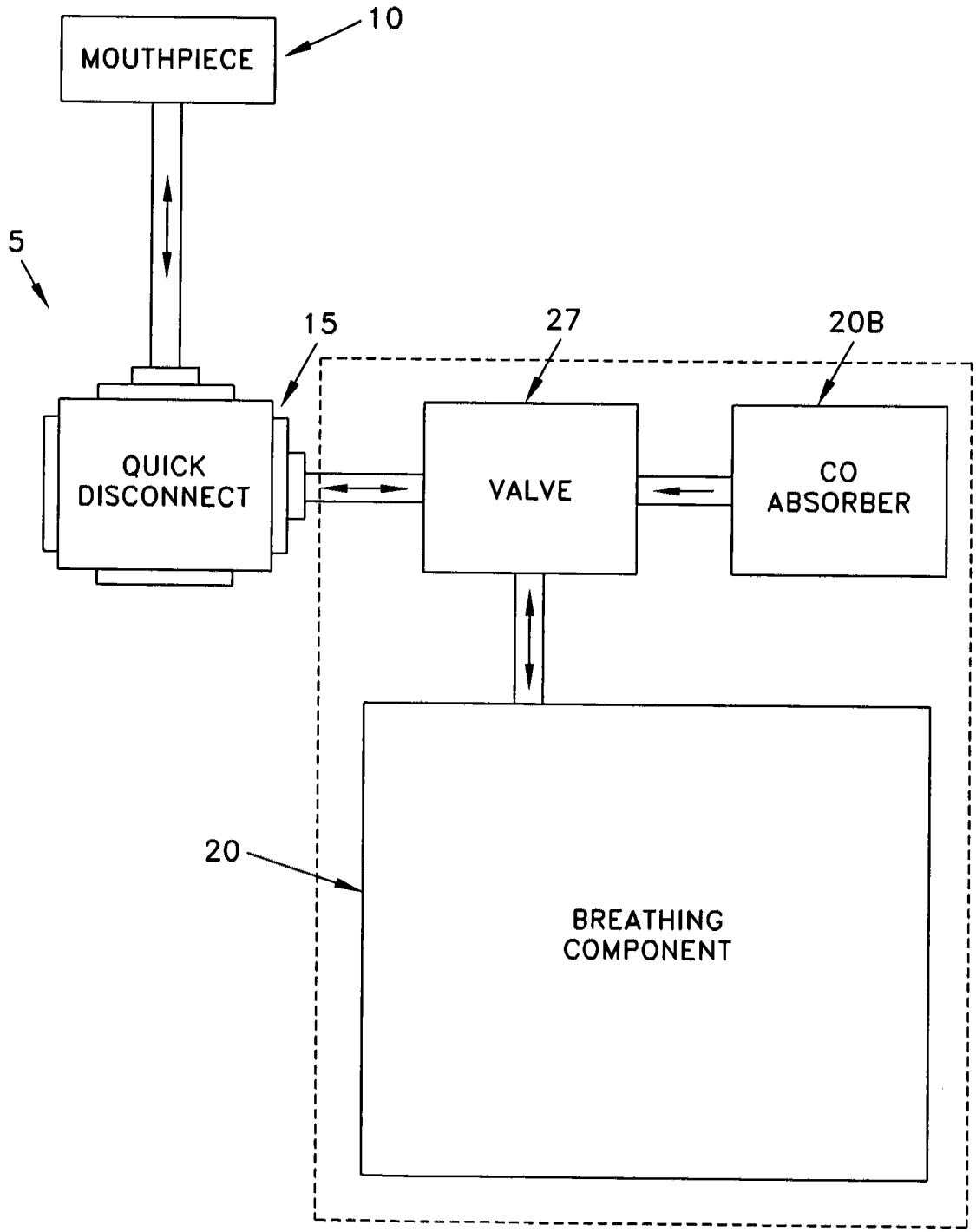
FIG. 28 is a schematic view illustrating an alternative approach for attaching various types of breathing components to safety quick disconnect.

In another form of the present invention, and looking next at FIG. 28, breathing component 20 and carbon monoxide absorber 20B can be housed within a single housing having a single interface for connection with quick disconnect 15. In this situation, a valve 27 is interposed between (i) the single interface and (ii) breathing component 20 and carbon monoxide absorber 20B. Valve 27 is used to switch between breathing component 20 and carbon monoxide absorber 20B. Thus, with this form of the invention, the miner can connect a single housing to quick disconnect 15, where that housing contains both breathing component 20 and carbon monoxide absorber 20B, and then use valve 27 to access the appropriate breathing element.

Breathing Air Monitor (BAM)

As noted above, where the miner has an SCBA system which provides a choice of different breathing options (e.g., connection to breathable air, use of a CO absorber, etc.), it would be beneficial for the miner to be given an indication of the nature of the atmospheric threat, in order that the miner might apply their SCBA system in the most efficient manner possible. By way of example but not limitation, where the SCBA has a limited supply of breathable air and a CO absorber, and where the atmospheric threat comprises CO, the miner might be best advised to utilize the CO absorber and conserve the limited supply of breathable air. On the other hand, if the atmospheric threat comprises methane, the miner will be best advised to use the limited supply of breathable air.

To this end, the present invention provides a breathing air monitor (BAM) for monitoring atmospheric conditions and alerting the miner to the presence of atmospheric threats.

Figure 29:
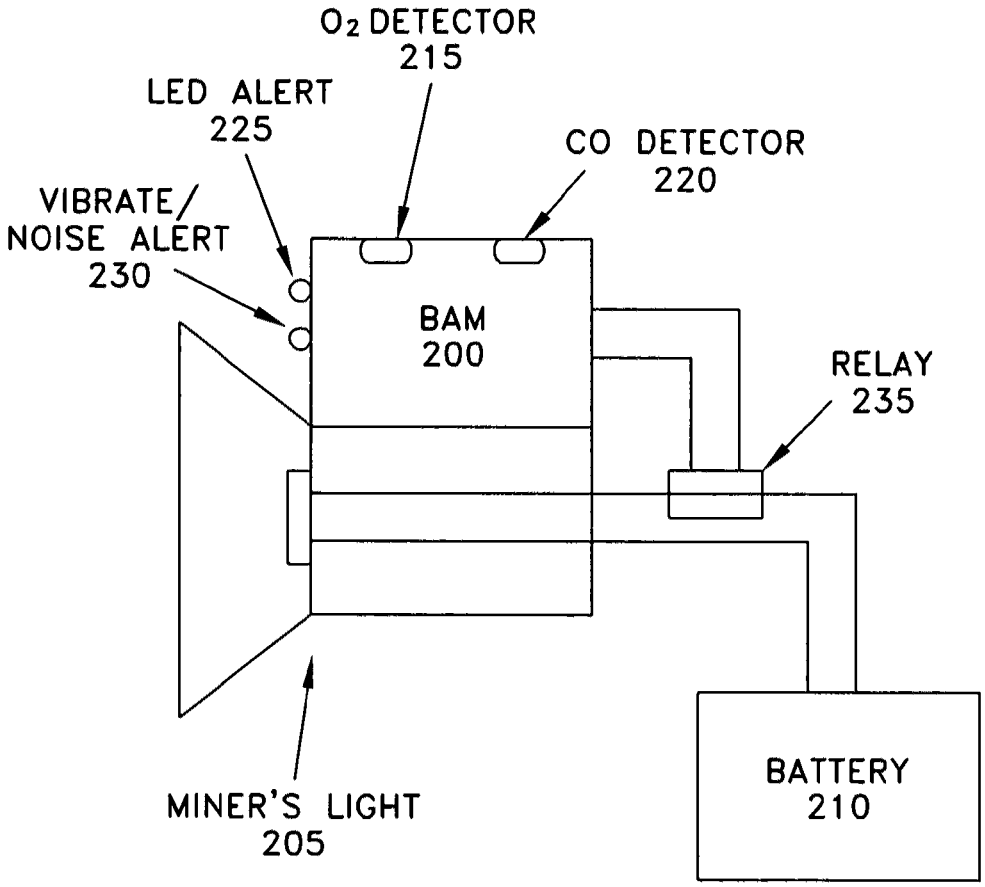
FIG. 29 is a schematic view illustrating a novel breathing air monitor (BAM) system formed integral with a miner's light.

More particularly, and looking now at FIG. 29, there is shown a breathing air monitor (BAM) 200 for monitoring atmospheric conditions and alerting a user to dangerous breathing conditions. In accordance with the present invention, breathing air monitor (BAM) 200 is formed integral with a miner's light 205 (e.g., a miner's light of the type mounted to a miner's helmet). Forming breathing air monitor (BAM) 200 integral with miner's light 205 provides a number of significant advantages. First, forming breathing air monitor (BAM) 200 integral with miner's light 205 eliminates the need for an additional or separate battery, as breathing air monitor (BAM) 200 can be powered by the battery 210 already provided for miner's light 205. Second, since a miner substantially always has their light with them while in the mine, the miner will also have breathing air monitor (BAM) 200 with them. Lastly, breathing air monitor (BAM) 200 can use the miner's light itself to alert the user to the presence of atmospheric hazards, as will hereinafter be discussed in further detail.

By way of example but not limitation, breathing air monitor (BAM) 200 may be used to sense low levels of oxygen and/or high levels of carbon monoxide. In one preferred form of the present invention, breathing air monitor (BAM) is configured to alert the user of conditions where $O_2$ levels fall below 19.5%, and/or when CO levels exceed 50 ppm. To this end, and still looking at FIG. 29, breathing air monitor (BAM) 200 is provided with an $O_2$ detector 215 and a CO detector 220. It should be appreciated that breathing air monitor (BAM) 200 may have other detectors in addition to, or as an alternative to, $O_2$ detector 215 and a CO detector 220, e.g., breathing air monitor (BAM) 200 may have a methane detector, a sulfur dioxide detector, etc.

When a dangerous situation is detected, breathing air monitor (BAM) 200 is configured to inform the user through a variety of alerts. To this end, breathing air monitor (BAM) 200 is provided with an LED alert 225 to visually alert the user to the presence of atmospheric hazards. LED alert 225 may be configured so as to turn on a certain colored light when a specific environmental condition is detected, e.g., yellow for low levels of oxygen, red for high levels of carbon monoxide, etc. LED alert 225 may also be configured to blink or flash in a variety of sequences or colors to indicate other specific environmental conditions and/or dangers.

Breathing air monitor (BAM) 200 is preferably also provided with a vibrate and/or noise alert 230. Like LED alert 225, vibrate/noise alert 230 alerts the user to the presence of atmospheric hazards. Vibrate/noise alert 230 can be automatically or manually set to vibrate, sound an alarm, or both, when a hazardous condition is detected. Furthermore, vibrate/noise alert 230 can also be automatically or manually set to vary the intensity and/or volume of the alert depending on specific environmental conditions or depending on user preference.

In addition to the foregoing, and as noted above, breathing air monitor (BAM) 200 preferably uses the miner's light beam as an additional user alert, by flashing the light. More particularly, if a certain $O_2$ or CO level is detected, breathing air monitor (BAM) 200 is configured to interrupt the power to the miner's light via a relay 235 disposed in the circuitry intermediate battery 210 and miner's light 205. Flashing the miner's light beam upon detection of the hazardous condition creates a readily recognizable alarm for both the miner and those thereby.

The aforementioned visual and/or audio alerts can be used individually or in conjunction with one another so as to alert the user when a hazardous breathing condition exists. Furthermore, the visual and/or audio alerts are configured to advise the user as to the particular type of danger that exists, which then allows the user to select an appropriate breathing component. By way of example but not limitation, when a toxic or oxygen-deficient condition is detected, the appropriate alert indicates that the user should begin using the SCBA, and preferably begin using the breathing component 20. Conversely, when a carbon monoxide condition is detected, a different alert will indicate that the user can instead safely use the CO absorber and, in turn, conserve their $O_2$ supply.

In one preferred form of the invention, the system is configured to flash the miner's light and sound an audio alarm when any atmospheric hazard is detected, and to light up a selected LED based upon the specific hazard detected.

It should be appreciated that the aforementioned alerts may also be set to have "soft alarm" and "hard alarm" conditions. A soft alarm condition can provide a warning of impending hazardous levels and a hard alarm condition can indicate the actual occurrence of hazardous levels. By way of example but not limitation, different colors, patterns or intensities may indicate the severity of the detected condition. Alternatively, the LED and vibrate/noise alarms may be associated with a soft alarm condition and the interruption of the miner's light may be associated with a hard alarm condition.

Breathing air monitor (BAM) 200 may also be provided with safety mechanisms including a low battery indicator, a reset button and a general on/off switch, etc.

Thus it will be appreciated that when breathing air monitor (BAM) 200 is combined with a miner's light, there is effectively created a "smart" light, i.e., a light capable of detecting the presence of a hazardous atmospheric condition and alerting a user to the same.

Figure 30:
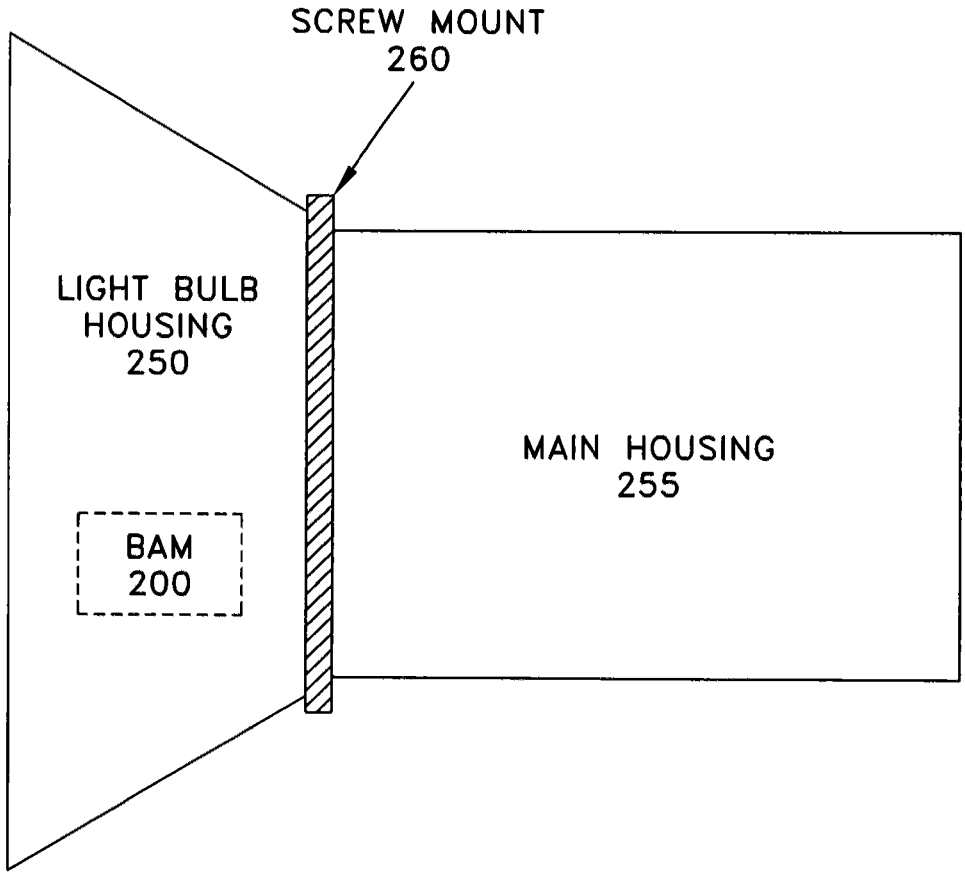
FIGS. 30 and 31 are schematic views illustrating the novel universal breathing air monitor (BAM) system retro-fitted on a pre-existing miner light.
Figure 31:
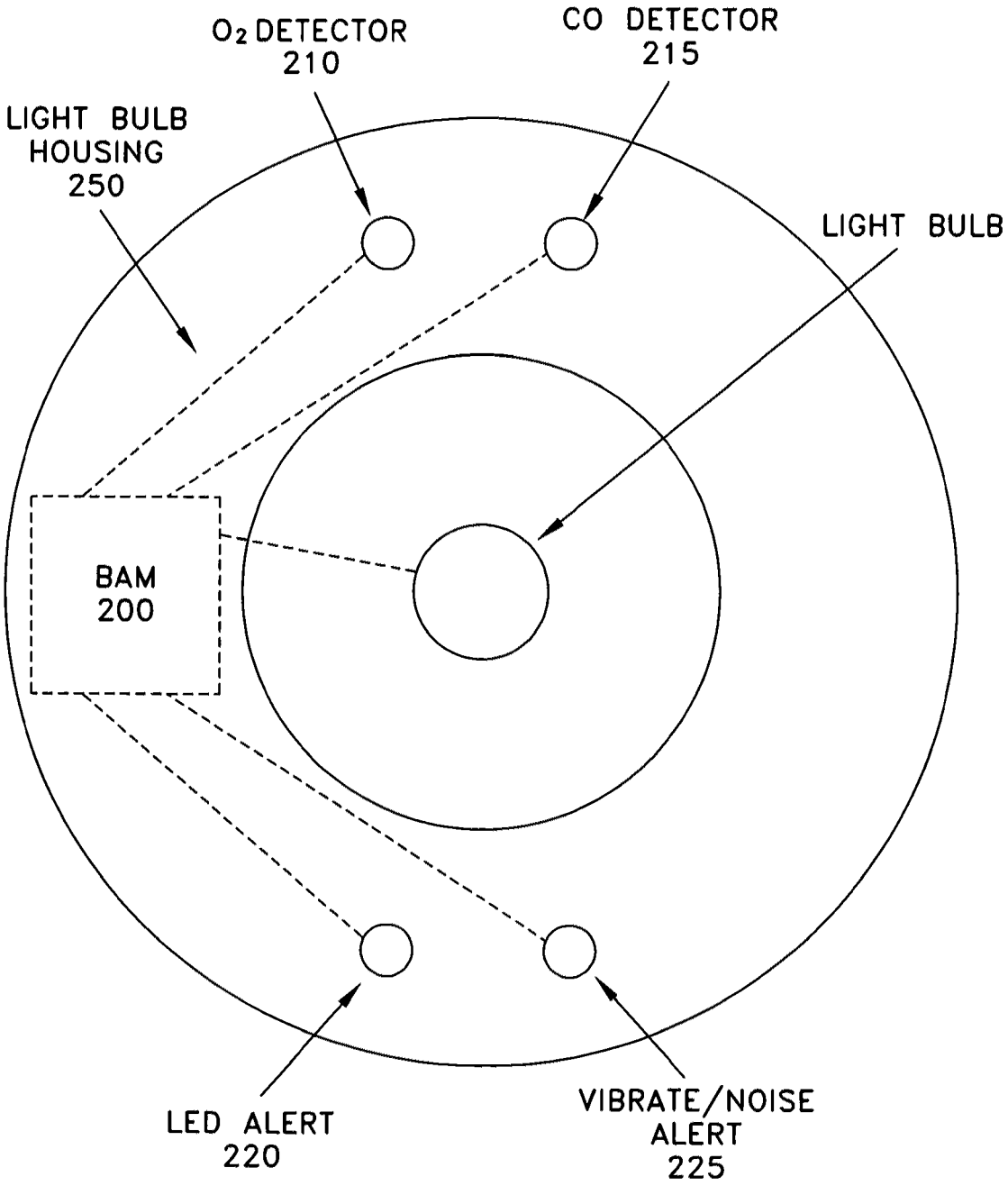

It should also be appreciated that the novel breathing air monitor (BAM) of the present invention is provided in a form which is consistent with the construction of miner's light 205. Thus, in one form of the invention, the miner's light is manufactured with the novel breathing air monitor (BAM) 200 already combined to the miner's light, e.g., within or as an expansion to the main housing of the miner's light. In another form of the invention, breathing air monitor (BAM) 200 is constructed so that it may be retroactively added onto an existing miner's light. Thus, in one form of the invention, and looking now at FIGS. 30 and 31, breathing air monitor (BAM) 200 is constructed as part of the light bulb housing 250 which is secured to the main housing 255 of the miner's light via a screw mount 260 or other attachment means. In this form of the invention, all of the components of breathing air monitor (BAM) 200 are contained in light bulb housing 250. This form of the invention is particularly advantageous, since it permits an existing miner's light to be easily retro-fitted with a breathing air monitor (BAM) 200 simply by switching out a traditional light bulb housing with the light bulb housing 250 formed in accordance with the present invention (i.e., one which incorporates a breathing air monitor (BAM).

Self Rescuer Including Self-Contained Breathing Apparatus (SCBA) and Breathing Air Monitor (BAM)

It should be appreciated that, by combining the breathing air monitor (BAM) of the present invention with the self-contained breathing apparatus (SCBA) of the present invention, a novel and highly advantageous self rescuer system can be provided. More particularly, since the SCBA system provides the miner with a choice of different breathing options (e.g., connection to breathable air, use of a CO absorber, etc.), and since the BAM system provides the miner with an indication of the nature of an atmospheric threat, the miner can apply their SCBA system in the most efficient manner possible. By way of example but not limitation, where the SCBA system has a limited supply of breathable air and a CO absorber, and where the BAM system advises the miner that the atmospheric threat comprises CO, the miner can choose to use the CO absorber and conserve the limited supply of breathable air. On the other hand, if the BAM system advises the miner that the atmospheric threat comprises methane, the miner can use the limited supply of breathable air provided by the SCBA system.

As used herein, the terms "CO absorber" and "carbon monoxide absorber" are intended to mean any apparatus which removes CO (carbon monoxide) from the air. Thus, the terms "CO absorber" and "carbon monoxide absorber" may refer to apparatus which literally absorbs CO (carbon monoxide) from the air, or it may refer to apparatus which includes a catalyst that oxidizes the CO (carbon monoxide) into $CO_2$ (carbon dioxide) whereby to "absorb" the CO (carbon monoxide) from the air (i.e., to remove the carbon monoxide from the air), etc.

Modifications

While the present invention has been described in terms of certain exemplary preferred embodiments, it will be readily understood and appreciated by those skilled in the art that it is not so limited, and that many additions, deletions and modifications may be made to the preferred embodiments discussed herein without departing from the scope of the invention.

What is claimed is:

1. A self-rescuer comprising:

a self-contained breathing apparatus (SCBA); and a smart light;

wherein the smart light comprises:

a battery;

a light bulb;

circuitry connecting the battery to the light bulb;

a detector for detecting the presence of a hazardous atmospheric condition; and alert apparatus connected to the detector for alerting a user when a hazardous atmospheric condition is detected by the detector, and further wherein the alert apparatus is connected to the circuitry and configured so as to flash the light bulb when a hazardous atmospheric condition is detected;

wherein the self-contained breathing apparatus (SCBA) comprises:

a mouthpiece;

a breathing component for providing breathable air, the breathing component comprising a component interface; and a safety quick disconnect comprising:

a valve body defining:

an internal chamber;

an opening communicating with the internal chamber and connectable with the mouthpiece;

first and second ports communicating with the internal chamber;

first and second mounts formed on the body adjacent to the first and second ports, respectively, for receiving the component interface of the breathing component, the first and second mounts being configured so as to place the breathing component into communication with the internal chamber when the component interface is in engagement with one or the other of the first and second mounts;

a valve spool selectively rotatably disposed within the internal chamber, wherein the valve spool comprises an L-shaped channel formed such that when the valve spool is appropriately rotated, the L-shaped channel (i) places the opening in communication with the first port, or (ii) places the opening in communication with the second port; and a lock mechanism for (i) preventing the valve spool from being rotated unless the component interface of the breathing component is positioned in one of the first and second mounts and a component interface of a replacement breathing component is positioned in the other of the first and second mounts, and (ii) preventing the removal of a component interface from a mount adjacent to a port which is in communication with the opening.

2. A self-rescuer according to claim 1 wherein the alert apparatus comprises a relay for selectively interrupting the electrical connection between the battery and the light bulb when a hazardous atmospheric condition is detected.

3. A self-rescuer according to claim 2 wherein the detector and the alert apparatus and the relay are mounted to the same housing as the light bulb.

4. A self-rescuer according to claim 1 wherein the alert apparatus further comprises a light emitting diode (LED) for emitting light when a hazardous atmospheric condition is detected.

5. A self-rescuer according to claim 1 wherein the alert apparatus further comprises a noise alarm for producing an audible tone when a hazardous atmospheric condition is detected.

6. A self-rescuer according to claim 1 wherein the alert apparatus further comprises a vibration alarm for producing a detectable vibration when a hazardous atmospheric condition is detected.

7. A self-rescuer according to claim 1 wherein the detector detects the level of oxygen in the atmosphere.

8. A self-rescuer according to claim 1 wherein the detector detects the level of carbon monoxide in the atmosphere.

9. A self-rescuer according to claim 1 wherein the detector and the alert apparatus are mounted to the same housing as the light bulb.

10. A self-rescuer according to claim 1 wherein the breathing component comprises an air tank.

11. A self-rescuer according to claim 1 wherein the breathing component comprises a filter.

12. A self-rescuer according to claim 11 wherein the breathing component comprises apparatus for removing unwanted gases from the air.

13. A self-rescuer according to claim 12 wherein the breathing component comprises apparatus for removing carbon monoxide from the air.

14. A self-rescuer according to claim 1 wherein the breathing component comprises the working portion of a self-contained breathing apparatus (SCBA).

15. A self-rescuer according to claim 14 wherein the working portion of the self-contained breathing apparatus (SCBA) comprises a carbon dioxide scrubber, and a counterlung.

16. A self-rescuer according to claim 15 wherein the counterlung is sized so as to have a volume which is approximately equal to the tidal volume of a pair of adult lungs.

17. A self-rescuer according to claim 15 wherein the working portion of the self-contained breathing apparatus (SCBA) further comprises a demand regulator disposed between the carbon dioxide scrubber and the component interface.

18. A self-rescuer according to claim 17 wherein the working portion of the self-contained breathing apparatus (SCBA) further comprises an oxygen supply connected to the demand regulator, and further wherein the demand regulator is configured to release oxygen from the oxygen supply when the pressure in the demand regulator falls below a given threshold.

* * * * *